US008635996B2

(12) United States Patent
Harman et al.

(10) Patent No.: US 8,635,996 B2
(45) Date of Patent: Jan. 28, 2014

(54) FEED SYSTEM FOR SOLID PARTICULATE FUEL BURNING STOVE

(75) Inventors: Dane P. Harman, Halifax, PA (US); Neil Sturm, Halifax, PA (US)

(73) Assignee: HNI Technologies Inc., Muscatine, IA (US)

( * ) Notice: Subject to any disclaimer, the term of this patent is extended or adjusted under 35 U.S.C. 154(b) by 1337 days.

(21) Appl. No.: 11/868,645

(22) Filed: Oct. 8, 2007

(65) Prior Publication Data

US 2008/0085172 A1 Apr. 10, 2008

Related U.S. Application Data

(60) Provisional application No. 60/828,717, filed on Oct. 9, 2006.

(51) Int. Cl.
*F24B 13/04* (2006.01)

(52) U.S. Cl.
USPC ..... 126/73; 126/68; 126/112; 110/255; 110/110; 414/187

(58) Field of Classification Search
USPC ..... 126/73, 68, 112, 76, 77; 414/187, 158; 110/255, 110, 109, 289, 233, 257
See application file for complete search history.

(56) References Cited

U.S. PATENT DOCUMENTS

| | | | | |
|---|---|---|---|---|
| 2,005,681 A | | 6/1935 | Norquist | |
| 2,084,237 A | | 6/1937 | Bartlett | |
| 3,604,462 A | * | 9/1971 | Dreher et al. | 138/139 |
| 4,278,067 A | | 7/1981 | Pike | |
| 4,478,054 A | * | 10/1984 | Shaw et al. | 62/323.4 |
| 4,651,709 A | * | 3/1987 | Schnetker | 126/77 |
| 4,672,946 A | | 6/1987 | Craver | |
| 4,803,973 A | | 2/1989 | Harman | |
| 5,018,455 A | | 5/1991 | Harman | |
| 5,285,738 A | | 2/1994 | Cullen | |
| 5,398,814 A | * | 3/1995 | Sime | 209/285 |
| 5,413,089 A | | 5/1995 | Andors et al. | |
| 5,797,333 A | * | 8/1998 | Hensley | 110/233 |
| 5,893,358 A | * | 4/1999 | Whitfield | 126/73 |

FOREIGN PATENT DOCUMENTS

| | | |
|---|---|---|
| EP | 0648976 A | 4/1995 |
| FR | 2514864 A | 4/1983 |
| GB | 843915 A | 8/1960 |
| GB | 2078933 A | 1/1982 |
| WO | 02079693 A | 10/2002 |

* cited by examiner

*Primary Examiner* — Avinash Savani

(74) *Attorney, Agent, or Firm* — McNees Wallace & Nurick LLC

(57) ABSTRACT

A fuel feed system for conveying particulate fuel from a hopper to a firebox in a stove is provided. The fuel feed system includes an inlet opening to receive particulate fuel and a fuel collection plate located below the inlet opening. A fuel passageway is located below the plate. The passageway includes a fuel delivery end located in a firebox and a fuel infeed end below the plate. A fuel delivery system moves fuel through the passageway from the infeed end to the delivery end. A motor actuates the fuel delivery system.

15 Claims, 11 Drawing Sheets

FEED SYSTEM FOR SOLID PARTICULATE FUEL BURNING STOVE

CROSS REFERENCE TO RELATED APPLICATIONS

This application claims the benefit of U.S. Provisional Application No. 60/828,717, filed Oct. 9, 2006, which is hereby incorporated by reference in its entirety.

BACKGROUND OF THE INVENTION

The present invention relates generally to a feed system for a stove that burns solid particulate fuels.

Stoves that burn solid particulate fuels such as wood products (e.g., pellets, chips, etc.), grains (e.g., shelled corn, barley, wheat, etc.), and pulverized coal for home heating are very popular. These stoves typically have a hopper or holding bin for the fuel and a fuel supply or feed system that transports the fuel from the hopper to the fire chamber to be burned. Some examples of feed systems include reciprocal pushers utilizing a pusher block or flat plates welded together, rotating cups and/or augers to move the fuel.

One problem with solid particulate fuel stoves is that dust and debris from the fuel can build up in the feed system. This build-up of dust and debris in the fuel system can block or limit the movement of rotating parts in the feed system thereby reducing the efficiency of the feed system or possibly preventing the feed system, and stove, from operating.

Another problem with solid particulate fuel stoves is that a significant amount of floor space is unavailable for use because of the size of the stove and its corresponding heat radius when operating. One of the factors that determines the size of the stove is the size of the feed system that is required to transport the fuel necessary to maintain a desired burn rate.

Furthermore, since the feed system operates in a high temperature environment and transports hard, abrasive fuel, the feed system is typically made from a heavy gauge steel or metal. The use of the heavier gauge materials results in manufacturing difficulties in assembling the feed system. For example, extensive welding may be required to connect adjoining pieces of the feed system. In addition, it can be difficult and time consuming to properly align the pieces of the feed system before the welding step occurs.

Therefore, what is needed is a compact and durable feed system for a stove that can be manufactured efficiently and easily, while limiting the build-up of dust and debris in the feed system. Exemplary embodiments of the invention may meet some or all of these needs.

SUMMARY OF THE INVENTION

An embodiment of the present invention is directed to a fuel feed system to convey particulate fuel from a hopper to a firebox. The system comprises a hopper interface having a plurality of sidewalls defining an inlet opening to receive particulate fuel, a support plate located below the inlet opening, a pusher plate assembly movably positioned on the support plate, a passageway including an infeed end below the support plate and a delivery end adjacent a firebox, a delivery system to move particulate fuel through the passageway from the infeed end to the delivery end, a motor configured and disposed to actuate both the delivery system and the pusher plate assembly and a dust removal system to direct fines to the passageway.

Another embodiment of the present invention is directed to a fuel feed system for a particulate fuel stove. The system comprises a housing, an auger tube located below the fuel collection plate, the auger tube including a delivery end located in a firebox and an infeed end located below the support plate, wherein the lower end of the fuel collection trough is adjacent the infeed end of the auger tube, an auger for moving fuel through the auger tube from the infeed end to the delivery end, a motor to actuate the auger and to reciprocate the pusher plate assembly and a dust removal system to direct dust to the auger tube without obstructing access to the auger via the access cover. The housing comprises an inlet opening to receive particulate fuel and angled sidewalls surrounding the inlet opening, a support plate disposed in the housing and located below the inlet opening having a fuel discharge edge, a pusher plate assembly disposed on the support plate, an access cover in a side of the housing and a fuel collection trough having a lower end and an upper end surrounding the fuel discharge edge of the support plate.

Yet another embodiment of the present invention is directed to a particulate fuel stove. The stove comprises a hopper configured to store particulate fuel, a firebox for burning the particulate fuel, an air intake passageway configured to deliver combustion air to the firebox and a fuel feed system configured to receive the particulate fuel from the hopper and deliver it to the firebox. The fuel feed system comprises a housing, a fuel passageway including an infeed end below the support plate and a delivery end adjacent the firebox, an auger to move particulate fuel through the fuel passageway from the infeed end to the delivery end and a motor configured and disposed to actuate both the auger and the pusher plate assembly. The housing comprises an inlet opening having angled sidewalls to receive the particulate fuel, a support plate disposed in the housing and located below the inlet opening having a fuel discharge edge, a pusher plate assembly disposed on the support plate, an access cover in a side of the housing and a fuel collection trough having an upper end surrounding the fuel discharge edge of the support plate and a lower end. The housing is separated from the firebox by at least two auger flights.

One advantage of the present invention is a compact design that reduces the size and weight of the stove and which permits an increased distance between the feed system housing and the firebox thereby increasing the safety of the stove.

A further advantage of the present invention is easy access to the auger of the feed system for maintenance purposes.

Another advantage of the present invention is the reduction of dust and debris build-up.

An additional advantage of the present invention is improved alignment of the auger in the auger tube which reduces noise and wear of the auger.

Another advantage of the present invention is the reduction of creosote build-up in the auger and auger tube.

Yet another advantage of the present invention is reduced time and cost for manufacturing and assembly.

Another advantage of the present invention is an economical feed system through the use of a common drive to power both the pusher assembly and the feed auger.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Exemplary embodiments of the invention are directed to an automatic feed system for supplying particulate fuel from a hopper to a stove firebox. The feed system features a drop separation space between a reciprocating feed pusher plate assembly under the hopper and an auger which transfers fuel from a catch trough to the firebox. This separation isolates the hopper fuel supply from the fire in the stove to prevent burnback into the hopper while reducing the complexity and number of moving parts used.

Figure 1:
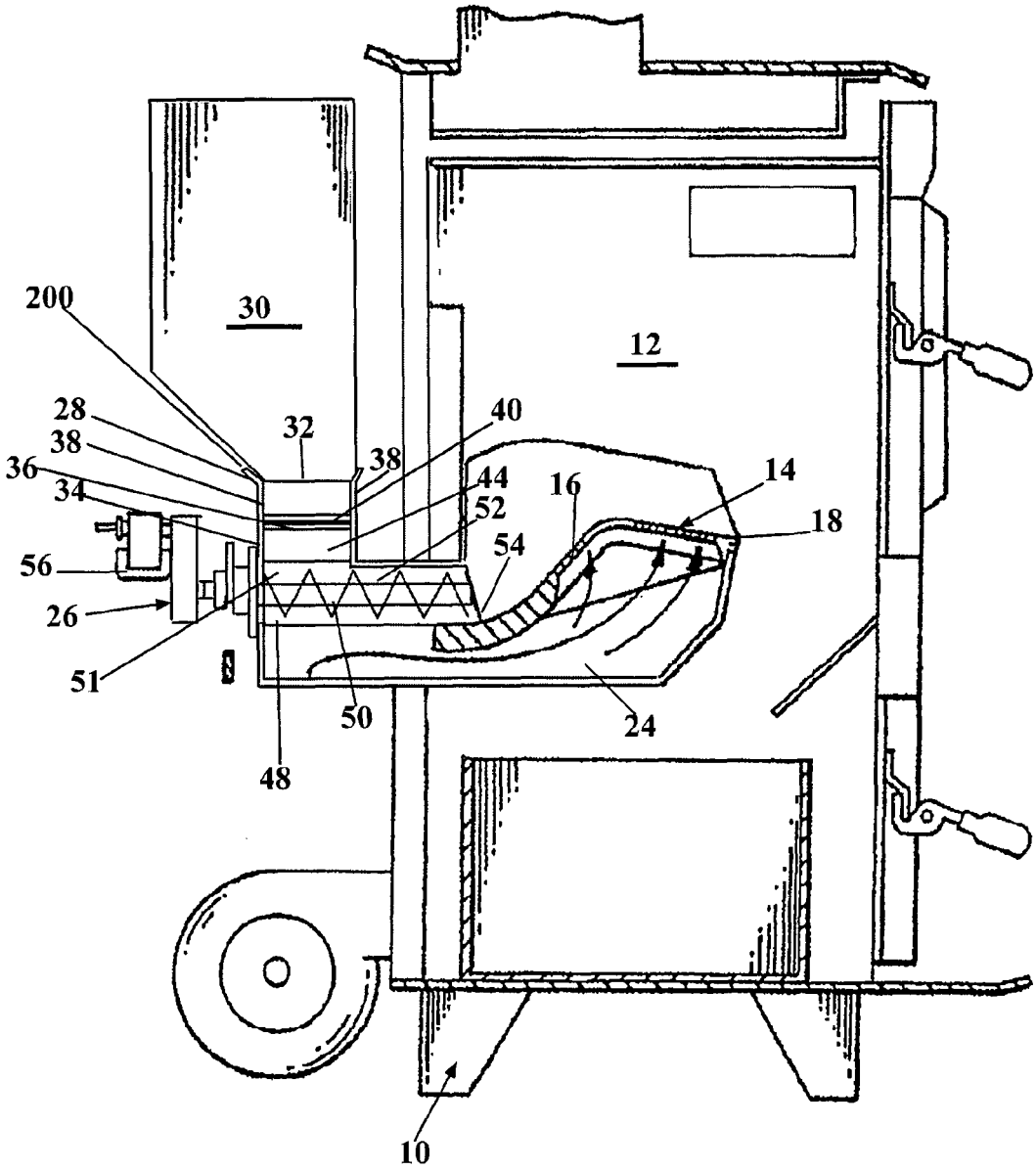
FIG. 1 illustrates a generalized vertical sectional view through a stove with the feed mechanism according to the present invention.

Referring to FIG. 1, a heating stove 10 includes a fire chamber or firebox 12 enclosing a grate 14 having a rise surface 16 and an ash discharge lip 18. Combustion air is provided by a combustion air system having a blower and an enclosed air intake passage 24. The combustion blower draws air through the air intake passage to the grate 14 where it supports combustion by flowing through holes in the grate 14.

Fuel feed system 26 is mounted on the back of stove 10 and includes a frame or housing 28 that has a fuel hopper 30 resting on top. The fuel hopper 30 rests upon a funnel shaped hopper attachment or hopper interface 200 that surrounds an inlet opening or mouth 32 that leads into an enclosure 34.

Figure 9:
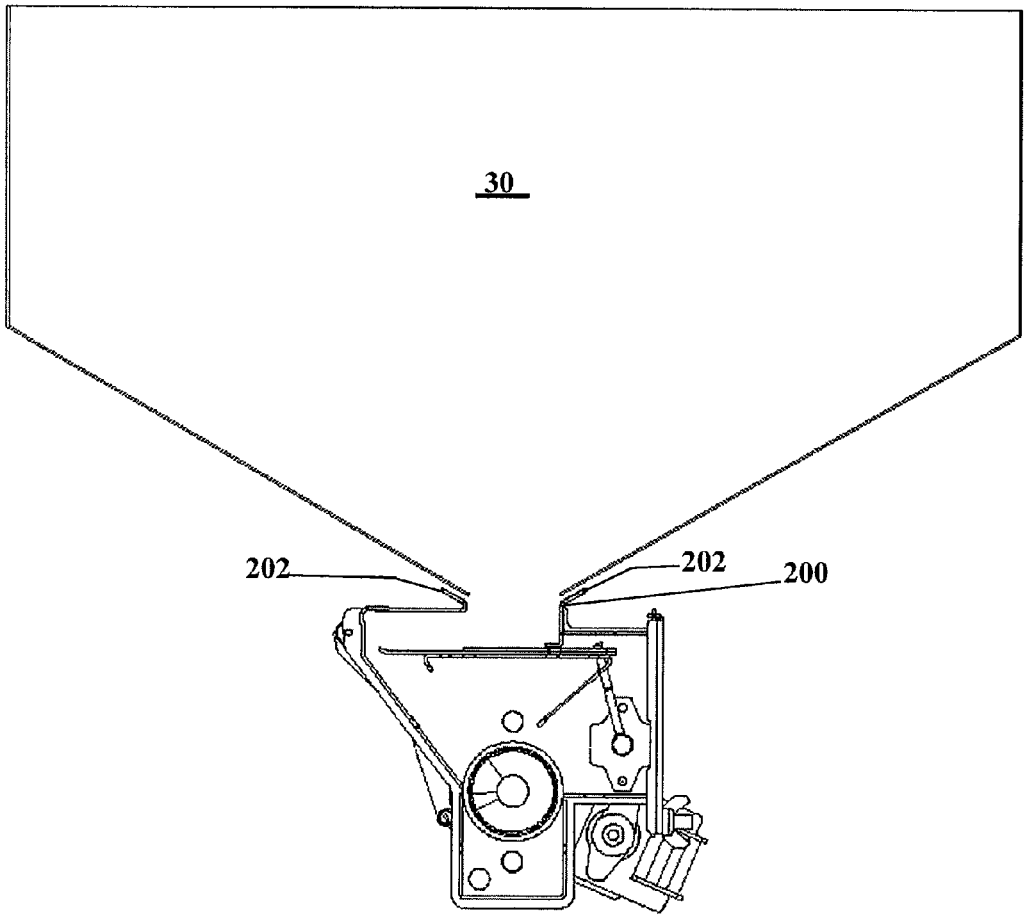
FIG. 9 illustrates a partial cross-sectional front view of the fuel feed system of the present invention interfacing with a hopper.

In one embodiment, better seen in FIG. 9, the hopper interface 200 includes angled sidewall members 202 upon which the hopper 30 rests. The hopper 30 and the angled members 202 can be sealed with a gasket (not shown). The angled members 202 are preferably sloped at a same angle as incorporated in the hopper 30. The use of the angled members 202 and the gasket avoids the need to use silicone caulk between the hopper 30 and the mouth 32 and does not require any undesirable manipulations on the hopper 30, such as the bending of tabs which could weaken the integrity of the feed system 26 at the hopper interface 200. As a result, the angled hopper interface 200 simplifies the production process and any future disassembly/repair procedures. In one embodiment, two tabs 204 extend outwardly from one or more of the angled members 202 to be used as wiring tie downs.

Figure 4:
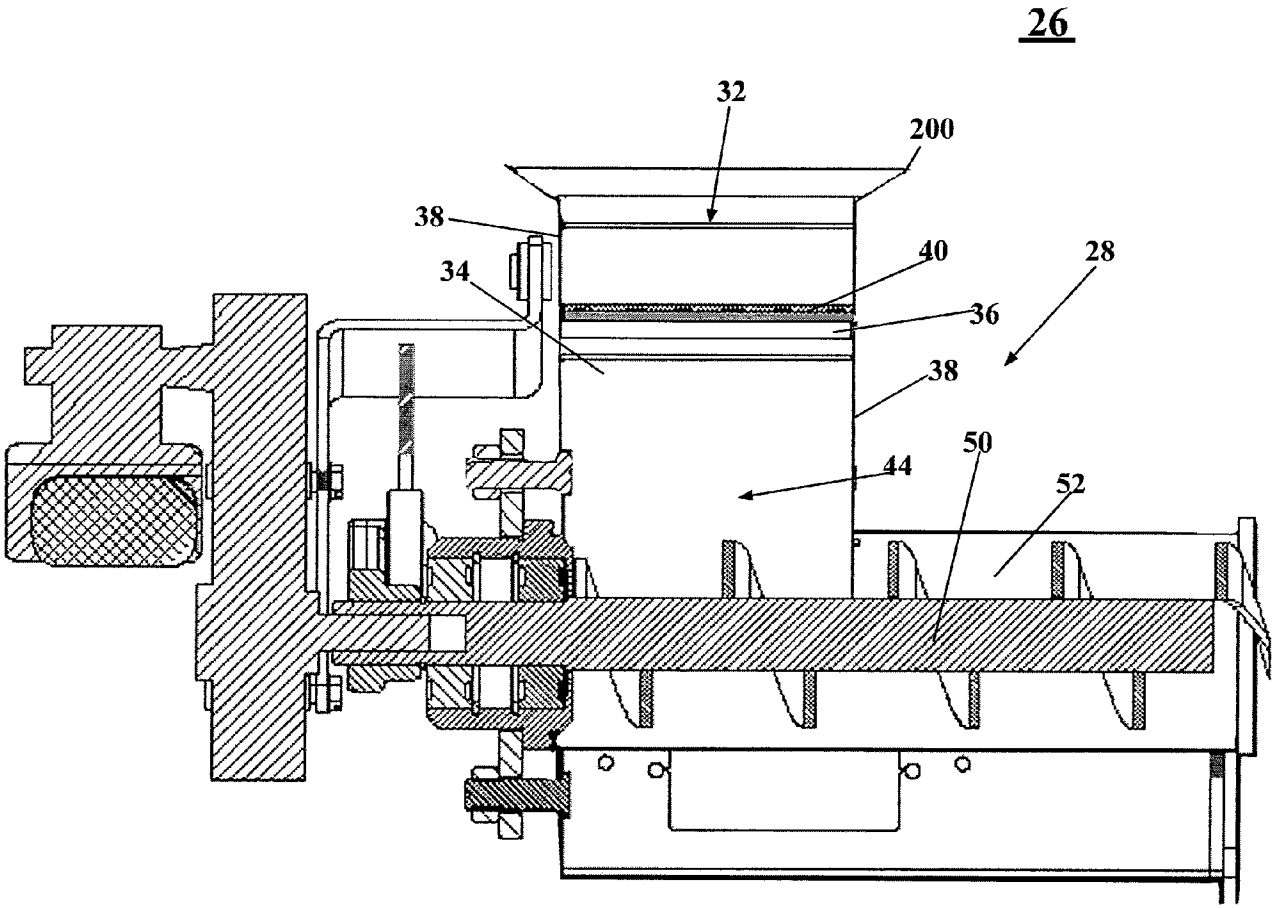
FIG. 4 illustrates a partial cross-sectional side view of the fuel feed system of the present invention.

Turning to FIG. 4, a horizontal support plate 36 is located below the mouth 32 and within the enclosure 34. The support plate 36 extends between vertical enclosure sidewalls 38. A pusher plate assembly 40 between the vertical sidewalls 38 rests on the support plate 36. As better seen in FIGS. 2A-2C, the pusher plate assembly 40 may include a base plate 100 that rests on the support plate 36 and a pusher plate 102 that is connected to the top of the base plate 100 and which is the same width but shorter in length than the base plate 100. The pusher plate 102 may be about three quarters to about one quarter the length of the base plate 100 and may be of the same thickness.

The pusher plate assembly 40 moves reciprocally across the support plate 36 as discussed in more detail below. The forward stroke of the pusher plate assembly 40 is in the direction of a plate discharge edge 42 of the support plate 36, better seen in FIG. 6.

Figure 2A:
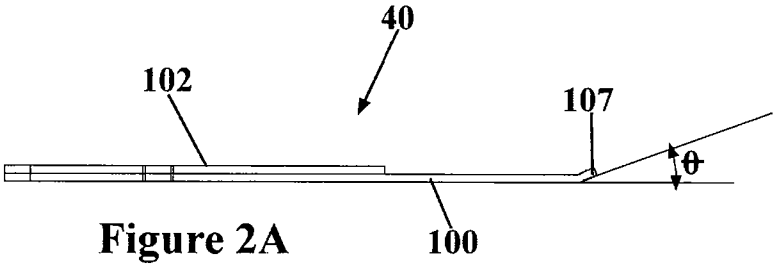
FIGS. 2A-2C illustrate different views of a pusher plate assembly used with the present invention.
Figure 2B:
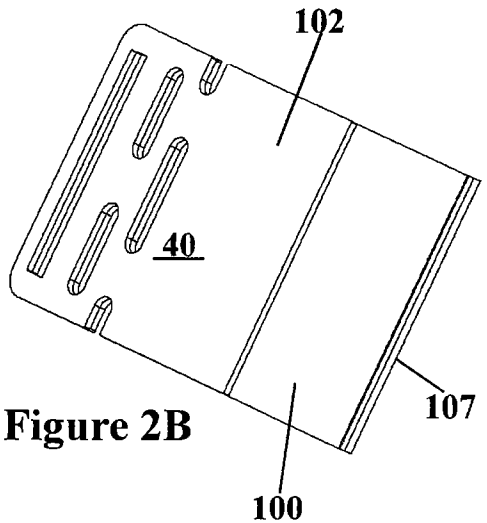
Figure 2C:
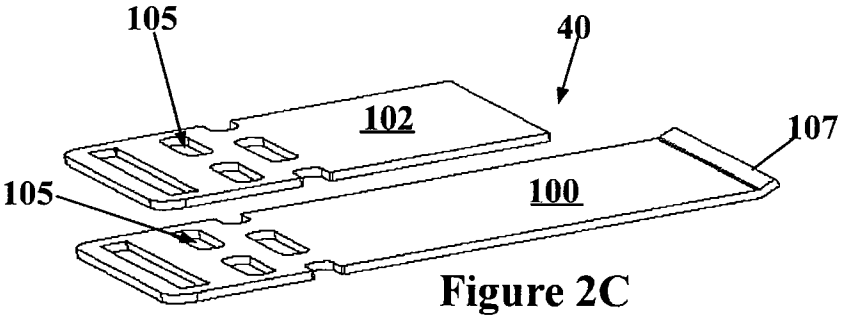
Figure 5:
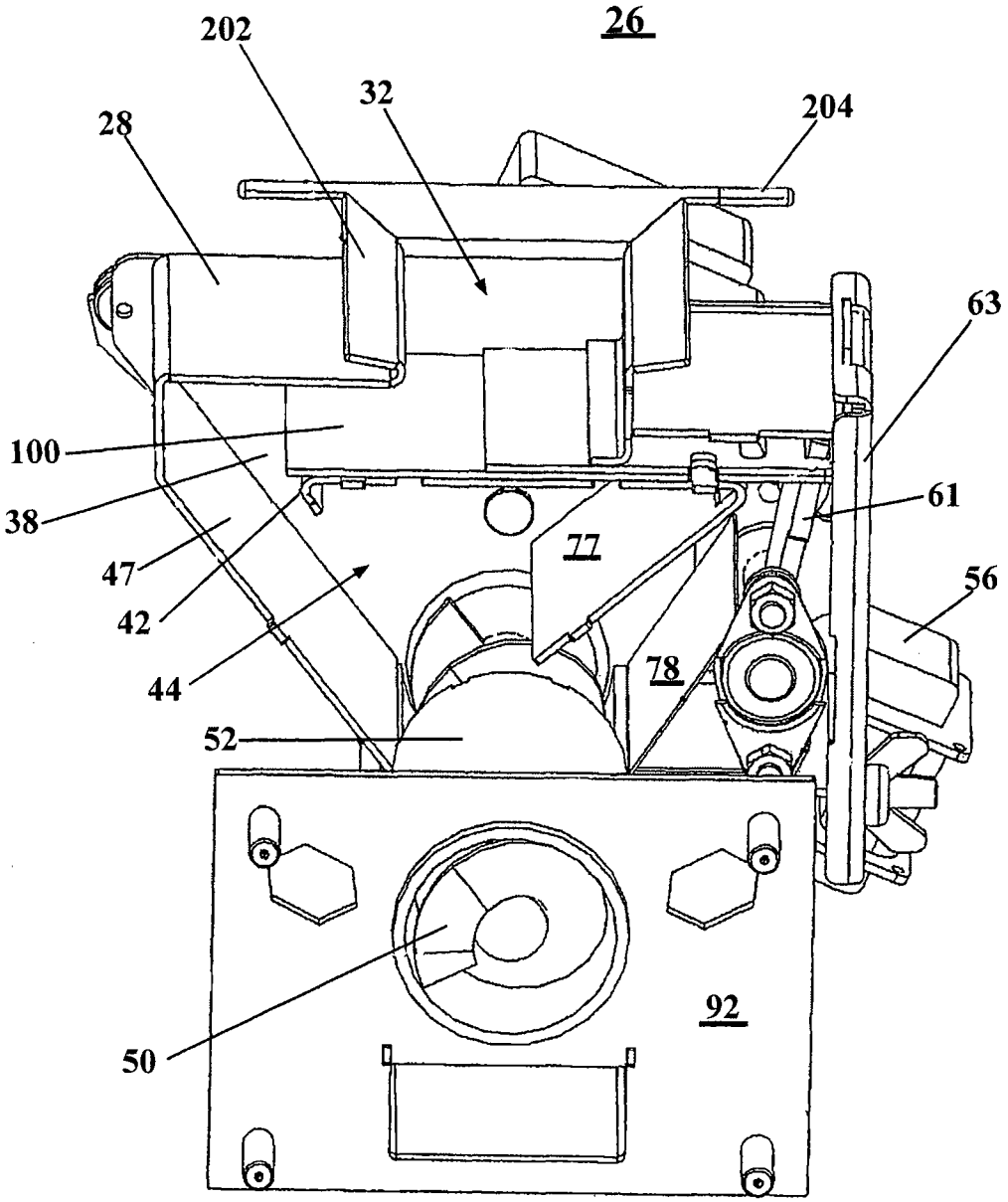
FIG. 5 illustrates a partial cross-sectional front view of the fuel feed system of the present invention.

In one embodiment, also illustrated in FIGS. 2A-2C, the base plate 100 includes a protrusion at or near the discharge end of the base plate 100, i.e., at or near the end of the base plate 100 that travels over the discharge edge 42 of the support plate. For example, the protrusion could be a lip, crimp, weld bead or additional member attached to the base plate 100. As illustrated in FIGS. 2A-2C, the protrusion is a lip 107. The use of a protrusion at the discharge end of the base plate 100 helps prevent overfeeding, especially where the particulate fuel is corn or another grain. The lip 107 extends upwardly away from the base plate 100 at a predetermined angle θ that is from about 5 degrees to about 45 degrees, preferably about 15 degrees to about 30 degrees. The lip 107 may be of any length, but is practically limited by the amount of available clearance within the housing 28 and the lip angle θ. It will be appreciated that the use of the lip 107 with the pusher plate assembly 40 is preferred, but θ the base plate 100 of the pusher plate assembly 40 can be flat in another embodiment, as illustrated in FIG. 5.

During stove operation, particulate fuel is gravity fed from the hopper 30 onto the pusher plate assembly 40 through the mouth 32 at the hopper interface 200. The side walls 38 confine the fuel to the plate surfaces of the pusher plate assembly 40. The pusher plate assembly 40, specifically the base plate 100, extends over the plate discharge edge 42 at the completion of the forward stroke. As the pusher plate assembly 40 begins the return stroke, fuel resting on the pusher plate assembly 40 is dropped into a drop separation area 44 and falls with the assistance of a sloping partition 47 (see FIG. 6) that directs the fuel into an open portion or trough 48 of a tubular feed passageway 52. The feed passageway 52 is used to connect the enclosure 34 at an infeed end 51 to the firebox 12 via a delivery end 54.

The drop separation area 44 between the fuel collection plate 36 and the bottom of the trough 48 is sufficiently great to prevent burnback between the trough 48 and the support plate 36. A delivery system transports fuel from the infeed end 51 of the feed passageway 52 to the firebox 12 at the delivery end 54 of the feed passageway 52 and is driven by a motor 56. As shown in FIG. 1, the delivery system includes an auger 50 located in the feed passageway/auger tube 52. The feed passageway/auger tube 52 is an integral part of the alignment and strength of the feed system 26. The auger tube 52 includes tabs and notches 152*a*/152*b* which are configured to fit with corresponding notches and tabs in other plates of the housing 28 to position and align the auger tube 52, which thereby allows an auger bearing assembly 146 to remain centered.

Figure 3:
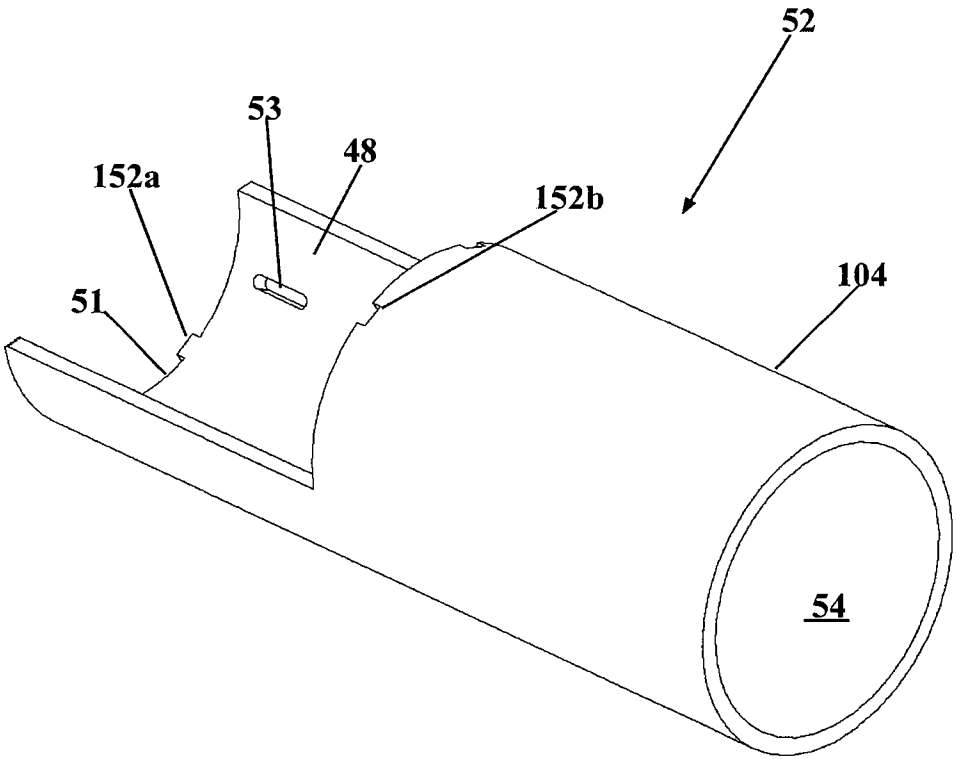
FIG. 3 illustrates the feed passageway of the present invention.

Next to the trough 48 is a closed portion 104 of the feed passageway 52, as better seen in FIG. 3. The closed portion 104 of the feed passageway 52 is attached to the front vertical side wall 38 of the housing 28 (FIG. 4) to seal the closed portion 104 of the feed passageway 52 from the outside. The trough 48 of the feed passageway 52 extends into enclosure 34 and is attached to the opposite vertical side wall 38 to seal the end of the trough 48 from the outside.

The feed passageway 52 provides additional physical isolation of the fuel supply from the combustion area to discourage burnback. In one embodiment, the closed portion 104 of the auger tube that separates the housing 28 from the firebox 12 has a length in the range of about three and half inches to about five inches. This permits the firebox 12 to be separated from the housing 28 by at least two auger flights (best illustrated in the cross-sectional view of FIG. 4). However, it will be appreciated that depending on the torsion of the auger flights, two auger flights may be achieved with a closed portion 104 that has a length greater or less than the preferred range. By separating the housing 28 and firebox 12 by at least two auger flights, the likelihood of burnback from the firebox 12 into the housing 28 is greatly reduced and provides for a significantly safer feed system 26 and stove 10.

As a result of the reduced likelihood of burnback and the additional distance between the housing 28 and the firebox 12, a lighter gauge metal can be used in the housing 28 and permits a 25% more compact feeder body than in conventional feed systems, significantly reducing production costs by requiring both less and lighter material. In one embodiment, the auger tube 52 is constructed of eleven gauge steel, while the housing 28 is constructed of fourteen gauge steel. Furthermore, the use of tabs and notches in other structural members of the housing 28 provides for additional self-alignment of the structural members and further permits the use of a lighter gauge metal in the housing 28.

In one embodiment, an auger intake aperture 53 is placed in the trough 48 of the auger tube 52 that allows a small amount of feed air to enter the housing 28 and auger tube 52 from the air intake passage 24 which assists in purging the feed passageway 52 of smoke and humidity/moisture. This in turn keeps the auger 50 and feed passageway 52 clean and prevents creosote buildup.

Returning to FIG. 5, a sloping fines plate 77 fixed between the vertical sidewalls 38 (in which the front sidewall 38 is removed for clarity) and extending downward from the support plate 36 provides additional support and reinforcement to the housing 28. The auger 50 can be accessed via a single wing nut clip on an access cover 63. Via this access, the auger 50 can be inspected directly for foreign objects or blockage without having to remove it from the feed passageway 52. In addition, inspection of the entire drop separation area 44 can also be accomplished from this single access point. Thus, the length and angle at which the fines plate 77 descends is preferably such that it does not obscure an observer's ability to view the auger 50 when the access cover 63 is removed.

As its name suggests, the fines plate 77 also assists with the removal of fines, such as dust and other debris (e.g., saw dust), from the housing 28. The fines plate 77 is part of a dust removal system that also includes openings 105 provided in the pusher plate assembly 40 that allow fines to fall through the pusher plate assembly 40 to the support plate 36. A pattern of slots 106 in the support plate 36 are also provided which prevents any build-up of fines that may cause tilting and/or jamming of the pusher plate assembly 40. These slots 106 allow the fines to continue to fall through the support plate 36 to the fines plate 77 which directs them into the feed passageway 52. Thus, the fines are carried away by the auger 50 and delivered to the fire, reducing the amount of fines that collect in the access space between the fines plate 77 and the access cover 63. Because the fines plate 77 is positioned intermediate the access cover 63 and the auger 50, but does not block access to the auger 50, those fines which do build up in the access space 79 between the fines plate 77 and the access cover 63 reach a certain height at which point they too fall by gravity downward into the trough 48 and are carried away by the auger 50.

In one embodiment, a removable deflector plate 78 may be positioned beneath the fines plate 77. Because the fines plate 77 is positioned to permit full access to the auger via the access cover, the removable deflector plate 78 deflects any pellets that may bounce off the sloping partition 47 or the auger 50, which would otherwise come to rest in the access space 79, back into the trough 48. However, because it is removable, the deflector plate 79 does not interfere with the ability to easily inspect the auger 50, drop separation area 44 and access space 79 via the access cover 63.

The reciprocating motion of the pusher plate assembly 40 is achieved via a pusher arm 61 driven by a rotating cam on the auger gear motor 56. This creates a push and pull aspect on the pusher plate assembly 40 creating a positive opening and closing movement, eliminating the use of springs or weights for closing force and thereby reducing the noise of crushing pellets. The pusher plate assembly 40 allows fuel pellets to fall into the trough 48 when the base plate 100 is pulled back and out from under the pellets. During the backward stroke, pellets resting on the pusher plate assembly 40 are forced toward the edge of the base plate 100. Thus, when the pusher plate assembly 40 pushes forward again, more pellets ride forward with the base plate 100, waiting for the next reverse stroke to drop.

Depending on the alignment of the pellets, especially if the pellets are standing on end, they may not ride forward with the base plate 100. The pusher plate 102 creates a pusher block like surface, which aids in knocking pellets over and coaxing them to ride forward with the forward movement of the pusher plate assembly 40.

Figure 6:
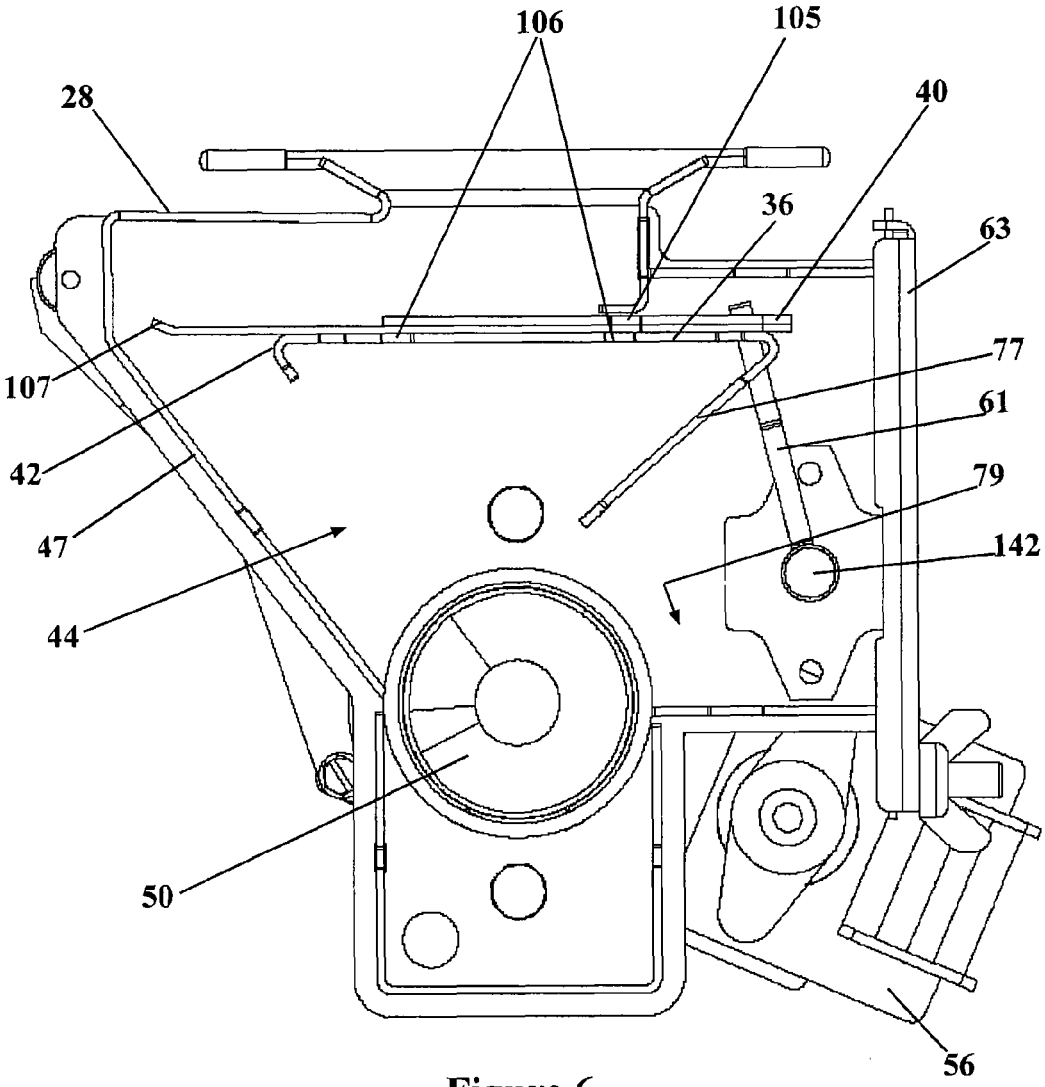
FIG. 6 also illustrates a partial cross-sectional front view of the fuel feed system of the present invention.
Figure 7:
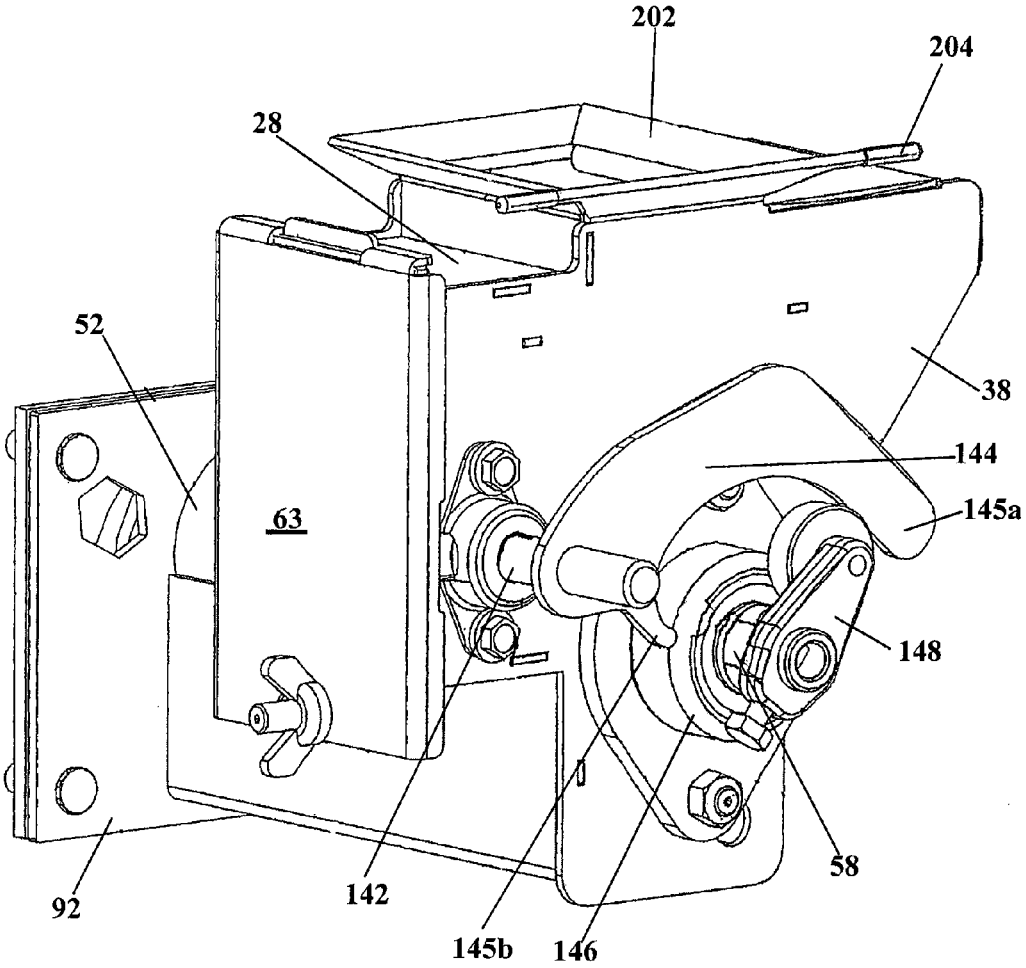
FIG. 7 illustrates a rear view of the fuel feed system of the present invention.

As seen in FIGS. 5-7, the fuel feed system 26 includes a drive motor 56 attached to a shaft 58 of the auger 50 positioned in the feed passageway 52. The auger shaft 58 carries a radial cam arm with a cam roller 148 at the outer end of the arm. Rotating the auger shaft 58 turns the attached cam arm and roller 148. The roller 148 engages tines 145*a*, 145*b* of a cam follower 144. The cam follower 144 is mounted on and oscillates a rock shaft 142 in response to rotation of the auger shaft 58. The pusher arm 61 extends radially out from the rock shaft 142 to engage the pusher plate assembly 40. The pusher arm extends through slots in both the base plate 100 and the pusher plate 102 (FIG. 2C) in order to be able to reciprocally move the entire pusher plate assembly 40.

Figure 8A:
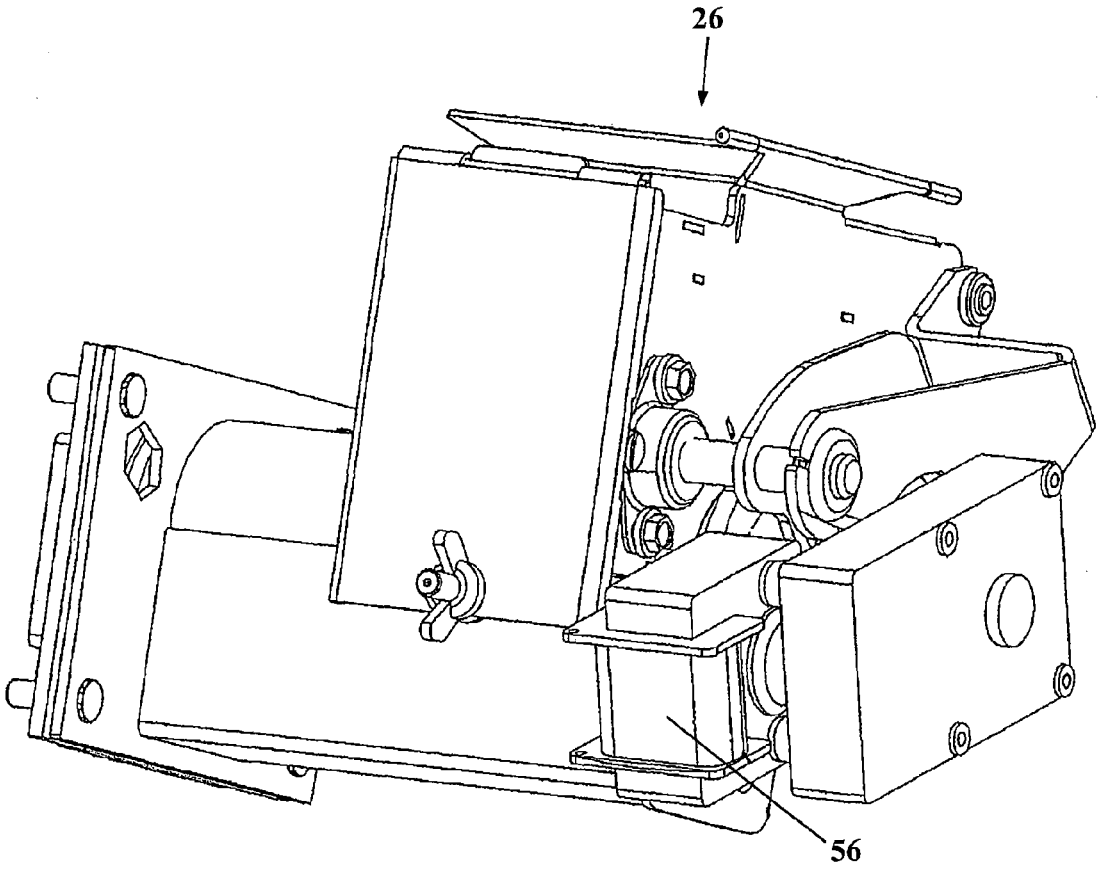
FIGS. 8A and 8B illustrate rear views of different embodiments of the fuel feed system of the present invention.
Figure 8B:
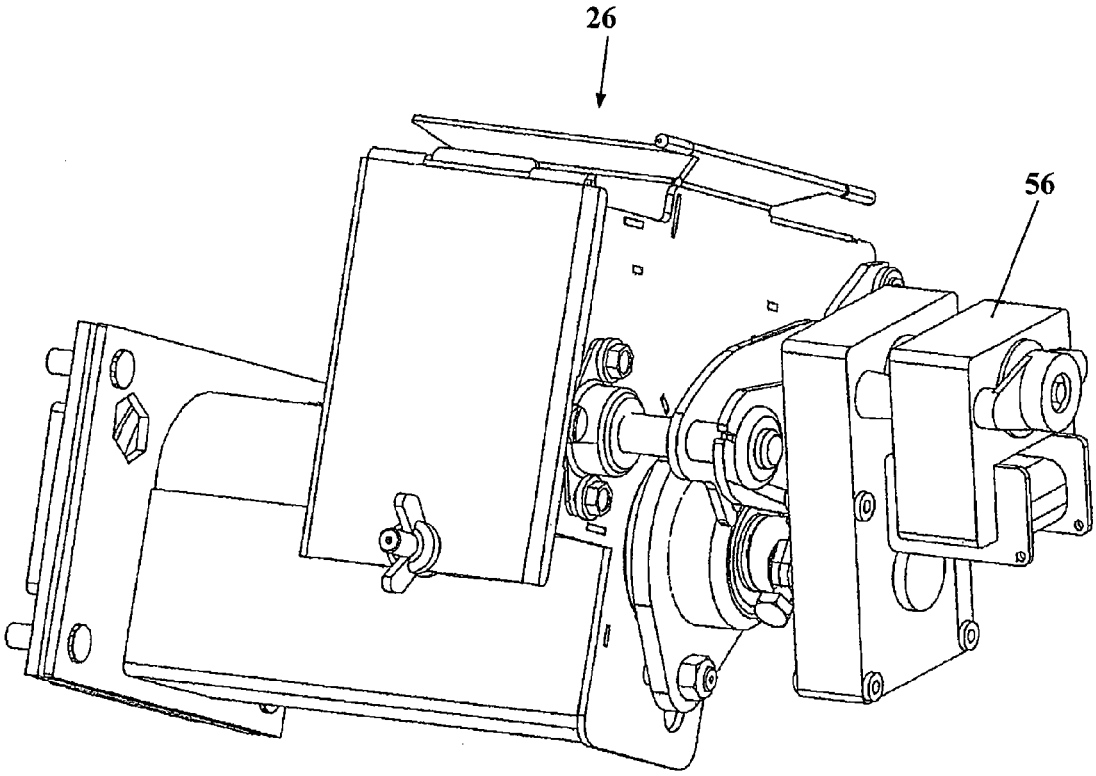

The auger gear motor 56 can be mounted on the same side of the housing 28 as the auger shaft 58, as shown in FIG. 8A. This orientation allows for reduced rear clearances and eliminates the need for chain drive alternatives. However, the motor 56 may be mounted directly behind the auger shaft as shown in FIG. 8B, or in any other suitable location.

The auger 50 is supported in the auger tube 52 by an auger bearing assembly 146. In one embodiment, the auger bearing assembly 146 is a dual roller bearing assembly which provides better alignment and reduced noise. These bearings help keep the auger centered in the auger tube and reduce the chance that auger flights will touch the side wall of the auger tube 52. In addition, these bearings can also operate at higher temperatures than pillow block bearings.

Figure 10:
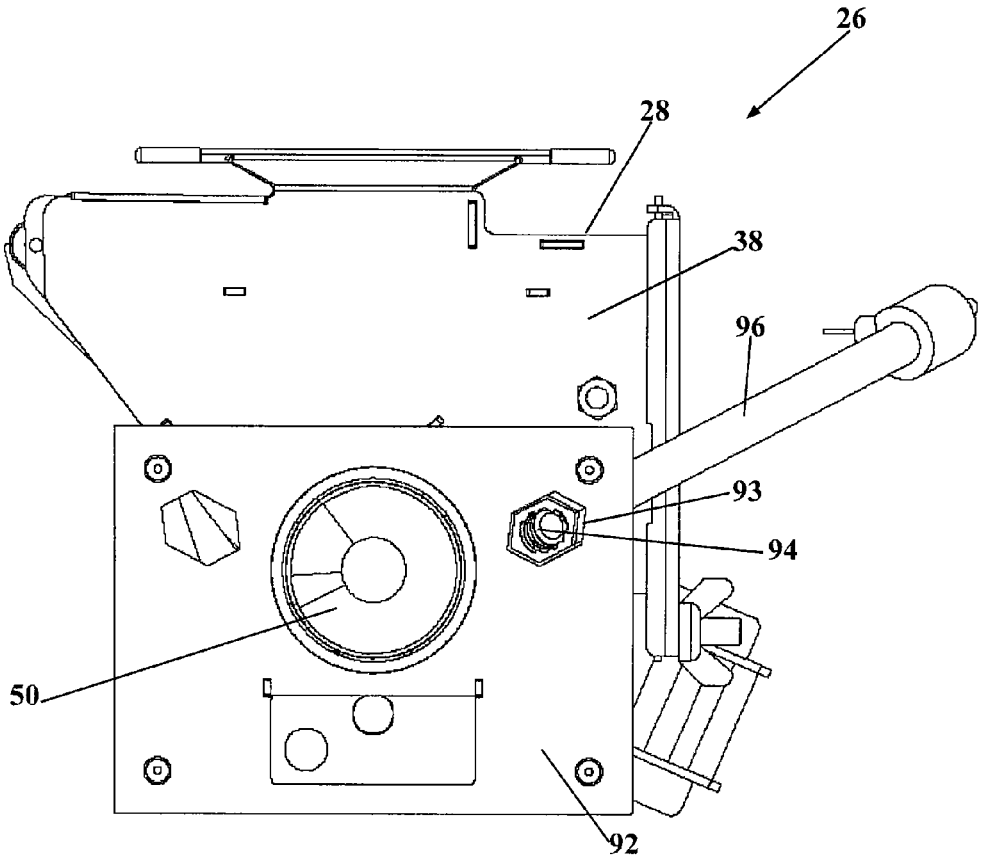
FIG. 10 illustrates a front view of the fuel feed system of the present invention with an igniter attached.

The fuel feed system 26 also may include an option that permits either one of two different ignition methods to be used. One option provides the connections to connect an ignition system that ignites via the air intake path through the burn grate 14 in the fire chamber for igniting all fuels, including anthracite coal which has a higher ignition temperature than most particulate fuels. The other option, shown in FIG. 10, provides a connection in which the igniter 96 is adjacent the auger tube 52 for above-the-grate ignition. As shown in FIG. 10, the igniter 96 is held in place through the use of a threaded coupling 94 situated within an aperture 93 formed in a feed flange plate 92 positioned at the delivery end 54 of the auger tube 52.

While the fuel system 26 described herein is intended primarily for use with wood pellets, it also can be used with other particulate fuels such as wood chips, grains (e.g., shelled corn, barley, wheat, etc.), pelletized biofuels, anthracite coal, walnut shells, peach pits and the like, by way of example only.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fuel feed system to convey particulate fuel from a hopper to a firebox, the system comprising:

a hopper interface having a plurality of sidewalls defining an inlet opening to receive particulate fuel;

a support plate located below the inlet opening; a pusher plate assembly movably positioned on the support plate, wherein the pusher plate assembly includes a base plate of a first length and a pusher plate overlying the base plate having a length less than the base plate, wherein the base plate includes a protrusion disposed adjacent a discharge end of the pusher plate assembly and extending upwardly from the pusher plate assembly;

a passageway including an infeed end below the support plate and a delivery end adjacent a firebox;

a delivery system to move particulate fuel through the passageway from the infeed end to the delivery end;

a motor configured and disposed to actuate both the delivery system and the pusher plate assembly; and a dust removal system to direct fines to the firebox via the passageway, wherein the dust removal system includes: a fines opening in the pusher plate assembly; a fines opening in the support plate; and a fines return plate positioned under the support plate and angled to direct fines into the passageway, wherein the fines return plate is intermediate the delivery system and an access cover and is angled and disposed to permit inspection of the passageway and delivery system.

2. The fuel feed system of claim 1, wherein the hopper interface has angled sidewall members.

3. The fuel feed system of claim 2, wherein the angled sidewall members correspond to a hopper angle.

4. The fuel feed system of claim 1, wherein the passageway includes an air intake aperture at the infeed end, whereby the air intake aperture connects the passageway with an air intake passageway.

5. The fuel feed system of claim 1, wherein the delivery system includes an auger mounted on an auger shaft.

6. The fuel feed system of claim 5, wherein the auger is mounted by an auger bearing assembly.

7. The fuel feed system of claim 6, wherein the auger bearing assembly is a dual roller bearing assembly.

8. The fuel feed system of claim 1, wherein the hopper interface sidewall includes an outwardly extending tab configured and disposed for attachment of wiring.

9. The fuel feed system of claim 1, wherein the base plate includes a protrusion disposed adjacent a discharge end of the pusher plate assembly and extending upwardly from the pusher plate assembly.

10. The fuel feed system of claim 9, wherein the protrusion is a lip having a predetermined angle of about 5 degrees to about 45 degrees.

11. A fuel feed system for a particulate fuel stove, the system comprising:

a housing, the housing comprising:

an inlet opening to receive particulate fuel and angled sidewalls surrounding the inlet opening;

a support plate disposed in the housing and located below the inlet opening having a fuel discharge edge;

a pusher plate assembly disposed on the support plate, wherein the pusher plate assembly includes a base plate of a first length and a pusher plate overlying the base plate having a length less than the base plate, wherein the base plate includes a protrusion disposed adjacent a discharge end of the pusher plate assembly and extending upwardly from the pusher plate assembly;

an access cover in a side of the housing; and a fuel collection trough having an upper end surrounding the fuel discharge edge of the support plate and a lower end;

an auger tube located below the fuel collection plate, the auger tube including a delivery end located in a firebox and an infeed end located below the support plate, wherein the lower end of the fuel collection trough is adjacent the infeed end of the auger tube;

an auger for moving fuel through the auger tube from the infeed end to the delivery end;

a motor to actuate the auger and to reciprocate the pusher plate assembly; and a dust removal system to direct dust to the auger tube and thereafter to the firebox without obstructing access to the auger via the access cover, wherein the dust removal system includes: a fines opening in the pusher plate assembly; a fines opening in the support plate; and a fines return plate positioned under the support plate and angled to direct fines into the passageway, wherein the fines return plate is intermediate the delivery system and an access cover and is angled and disposed to permit inspection of the passageway and delivery system.

12. The fuel feed system of claim 11, wherein the auger tube includes a plurality of alignment tabs and notches configured to align the fuel delivery passage with the housing and wherein the housing is constructed of a lighter gauge metal than the auger tube.

13. The fuel feed system of claim 11, wherein the auger tube includes an air intake aperture at the infeed end, whereby the air intake aperture connects the auger tube with an air intake passageway.

14. A particulate fuel stove comprising a hopper configured to store particulate fuel; a firebox for burning the particulate fuel; an air intake passageway configured to deliver combustion air to the firebox; and a fuel feed system configured to receive the particulate fuel from the hopper and deliver it to the firebox, the fuel feed system comprising:

a housing, the housing comprising:

an inlet opening having angled sidewalls to receive particulate fuel; a support plate disposed in the housing and located below the inlet opening, the support plate having a fuel discharge edge; a pusher plate assembly disposed on the support plate; an access cover in a side of the housing, wherein the pusher plate assembly includes a base plate of a first length and a pusher plate overlying the base plate having a length less than the base plate, wherein the base plate includes a protrusion disposed adjacent a discharge end of the pusher plate assembly and extending upwardly from the pusher plate assembly; and a fuel collection trough having an upper end surrounding the fuel discharge edge of the support plate and a lower end; a fuel passageway including an infeed end below the support plate and a delivery end adjacent the firebox, wherein the fuel passageway includes a plurality of alignment tabs and notches configured to align the fuel passageway with the firebox, the fuel passageway having an air intake passageway at the infeed end to connect the fuel passageway with the air intake passageway, such that a portion of the combustion air enters the firebox via the fuel passageway; an auger to move the particulate fuel through the fuel passageway from the infeed end to the delivery end; a dust return system including a fines opening in the pusher plate assembly, a fines opening in the support plate, and a fines return plate extending from and positioned under the support plate, wherein the fines return plate is intermediate the delivery system and an access cover and is angled and disposed to both direct fines into the firebox via the fuel passageway and to permit inspection of the fuel passageway and the auger; and a motor configured and disposed to actuate both the auger and the pusher plate assembly, wherein the housing is separated from the firebox by at least two auger flights, and wherein the housing is constructed of a lighter gauge material than the fuel passageway.

15. The particulate fuel stove of claim 14, wherein the fuel feed system further comprises:

a feed flange plate at the delivery end of the fuel passageway, an aperture in the feed flange plate;

a threaded coupling positioned within the feed flange plate aperture; and an igniter attached to the feed flange plate via the threaded coupling.

* * * * *